United States Patent [19]

Reid

[11] 4,057,384

[45] Nov. 8, 1977

[54] CLAY CENTERING DEVICE FOR A POTTER'S WHEEL

[76] Inventor: William Vincent Reid, 51 Pinelands Road, Sunnybank Hills, Queensland 4019, Australia

[21] Appl. No.: 755,065

[22] Filed: Dec. 28, 1976

[30] Foreign Application Priority Data

Jan. 30, 1976 Australia ..... 4677/76

[51] Int. Cl.[2] ..... B28B 1/29

[52] U.S. Cl. ..... 425/459; 425/263

[58] Field of Search ..... 425/263, 459, 218, 264, 425/458, DIG. 120

[56] References Cited

U.S. PATENT DOCUMENTS

| | | | |
|---|---|---|---|
| 1,559,513 | 10/1925 | Ward | 425/263 |
| 2,080,418 | 5/1937 | Gould | 425/263 |
| 3,451,359 | 6/1969 | Glasgow | 425/263 |
| 3,520,036 | 7/1970 | Maloney | 425/264 X |

*Primary Examiner*—Robert D. Baldwin
*Assistant Examiner*—John S. Brown
*Attorney, Agent, or Firm*—Donald D. Jeffery

[57] ABSTRACT

A clay centering device for a potter's wheel consists of a flat slab mounted on an arm which has at one end a handle and at the other end is releasably engaged rotatably and in universally pivotal manner to a mounting clamp secured to the rim of the tray of the potter's wheel. By means of the handle, the slab may be moved across the potter's wheel, its normally lower edge against the top of the wheel, to contact and center a piece of clay on the revolving wheel. The slab is adjustably fixed on the arm, which is telescopically adjustable.

3 Claims, 1 Drawing Figure

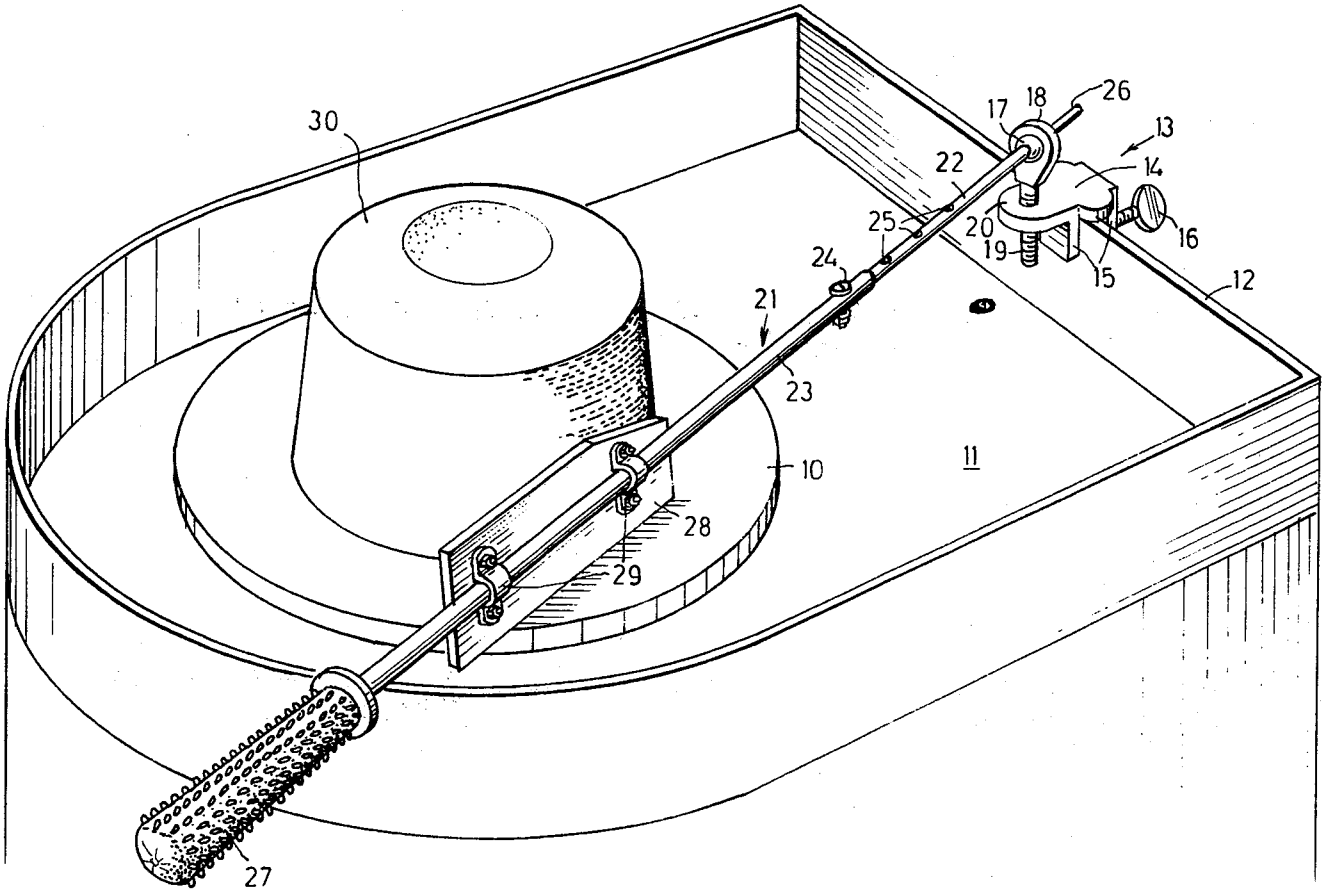
10
11
12
13
14
15
16
17
18
19
20
21
22
23
24
25
26
27
28
29
30

CLAY CENTERING DEVICE FOR A POTTER'S WHEEL

BACKGROUND OF THE INVENTION

This invention relates to a clay centering device for a potter's wheel.

In using a potter's wheel, a good deal of skill is required in centering the clay upon the wheel. This is normally done with the hands as the wheel is turned, and even for experienced potters it is an operation that takes some time. For a beginner, it is a source of great difficulty, and largely for this reason, people learning the craft are unable to do satisfactory work on a potter's wheel until they have practiced for a very considerable period.

As the hands are dipped in water before working the clay, it will be appreciated that the longer the time taken in centering the clay upon the wheel, the more water is likely to be absorbed into the clay so that, unless this initial operation is completed reasonably quickly, the clay will be brought to a consistency which is unsuitable for good work.

SUMMARY OF THE INVENTION

The present invention has been devised with the general object of providing a device by means of which clay may be very quickly and easily centered on a potter's wheel without any high degree of skill being required, so that a beginner in the craft may, with the assistance of the device, gain early experience in this very important aspect of the work, and an experienced potter may save a considerable amount of time in his production of pottery. Other objects of the invention are to provide such a device which is readily applicable to, and adjustable for, all conventional potters' wheels, which is easily adjusted to suit the centering of pieces of clay of differing sizes, and which is simple and economical to manufacture and sturdy and durable in use.

With the foregoing and other objects in view, the invention resides broadly in a clay centering device for a potter's wheel including an arm; a centering slab, with a substantially straight normally bottom edge, mounted on the arm; a handle on one end of the arm; and mounting means for mounting the other end of the arm pivotally at a position to one side of a potter's wheel so that the arm may be swung substantially horizontally across part of the potter's wheel, the normally bottom edge of the centering slab close to or in contact with the upper face of the wheel. Preferably the mounting means is a clamp removably attachable to the rim of the tray of the potter's wheel, and a ball and socket connection between the arm and the clamp, from which connection the arm may be withdrawn; and preferably the centering slab is longitudinally adjustable on the arm which itself is telescopically adjustable. Other features of the invention will become apparent from the following description.

BRIEF DESCRIPTION OF THE DRAWING

A preferred embodiment of the invention is shown in the accompanying drawing, which is a perspective view of a clay centering device applied to a conventional potter's wheel.

DETAILED DESCRIPTION OF THE PREFERRED EMBODIMENT OF THE INVENTION

The potter's wheel 10 is a disc, its axis vertical, driven in any suitable way, and located above the bottom of a tray 11 with an upstanding rim 12.

The clay centering device includes a mounting clamp 13 with a substantially horizontal top plate 14 from which a pair of jaws 15 extend downwardly, one for location inside, the other outside, the tray rim 12, a clamp screw 16 engaged in a tapped hole through the outside jaw 15 being tightened to engage the rim and hold the mounting clamp in place.

A diametrically apertured ball 17 is securely retained, but freely movable, in a socket 18 on the normally upper end of a threaded shank 19 which is screwed into a tapped hole formed down through a lug 20 projecting from the mounting clamp top plate 14.

The device includes a telescopic arm 21 consisting of an inner tube 22 closely but slidably engaged in an outer tube 23. A retaining screw 24 passing through diametrically opposed holes in the outer tube 23 and through any selected one of a series of diametral holes 25 in the inner tube 22 holds the two parts of the telescopic arm in desired adjusted relationship. A pin 26 secured in and extending from the outer end of the inner tube 22 is of such diameter that it may be slidably engaged in the hole formed through the ball 17, the shoulder formed by the extremity of the inner tube 22 limiting the slidable engagement of the telescopic arm with the mounting clamp ball.

On the other end of the telescopic arm 21, a handle 27 is fixed upon the outer tube 23. This handle is required to afford a good grip to the hand even when slippery with water and clay, and may suitably be moulded of a resilient plastic material with a multiplicity of small projections.

A centering slab 28 is mounted adjustably on the telescopic arm 21. This slab may suitably be made of wood, in the form of a rectangle with the corner which is normally at the top and nearer to the mounting clamp removed by an oblique cut. The device is so made and arranged, and mounted, that the bottom edge of the centering slab, when the slab is vertical, will rest flush on the top of the potter's wheel 10. The telescopic arm is held to the back of the centering slab 28, about midway between its top and bottom edges, by means of a pair of clamp brackets 29 secured by screws the heads of which are countersunk in the front face of the slab, and by nuts engaged with the screws. If the screws are slackened, the centering slab may be moved slidably along the telescopic arm to desired position, and locked in place by re-tightening the screws.

In use, a piece of clay, as indicated at 30, is placed, roughly centrally, on the wheel 10. The pin 26 is engaged in the ball and socket device of the mounting clamp, to which the telescopic arm is thus connected universally for pivotal movement in any direction as well as rotatably about its axis. The potter's wheel is rotated and the potter, by grasping the handle 27, moves the centering slab 28 against the side of the clay piece 30, rapidly bringing the rotating malleable clay into correctly centered position. By twisting the handle 27, the potter can cause the centering slab 28 to incline so as to do some initial shaping of the clay. When the centering device is no longer required, the telescopic arm may be quickly disengaged from the ball and socket joint of the mounting clamp and put to one side.

The effective length of the telescopic arm may be adjusted to suit different types of potter's wheels; and the location of the centering slab on the telescopic arm may be varied to suit different sizes of clay to be centered on the wheel.

It will be found that the device will enable students of pottery to acquire skill on a potter's wheel far quicker than would be the case if the clay were required to be centered by hand, and it will also enable skilled potters to carry out the centering operation more quickly and easily than by conventional methods. The device may be made simply and economically, and should be sturdy, durable and troublefree in use.

I claim:

1. A clay centering device for a potter's wheel including:

a elongated arm, a centering slab, with a substantially straight normally bottom edge, mounted on the arm, a handle at one end of the arm, and mounting means attachable to the tray of a potter's wheel, said arm being rotatable about its longitudinal axis, and also being universally pivotable within said mounting means, the arm being adapted to be moved by means of the handle to bring the centering slab across the top of the potter's wheel, its bottom edge in contact therewith, to center a piece of clay on the wheel, to be raised and lowered to bring the centering slab above or down to the wheel, and to be twisted about its axis of rotation to vary the angle of inclination of the centering slab to the top of the wheel to shape the clay on the wheel.

2. A clay centering device for a potter's wheel according to claim 1 wherein the mounting means includes:

a clamp, a ball and socket device mounted in vertically adjustable manner of the clamp for oscillation about a substantially vertical axis, the ball of the ball and socket device being axially apertured to receive removably the end of the arm remote from the handle.

3. A clay centering device according to claim 1 wherein:

the arm is comprised of two telescopically interfitted parts, and means releasably holding said parts in desired longitudinal adjustment, and means for mounting said centering slab in longitudinally adjustable manner on the arm.

* * * * *